US005960957A

United States Patent [19]

Johnson

[11] Patent Number: 5,960,957

[45] Date of Patent: Oct. 5, 1999

[54] PLASTIC BAG ORGANIZER AND STORAGE APPARATUS

[76] Inventor: Arthur L. Johnson, P.O. Box 891, Williamsburg, Iowa 52361

[21] Appl. No.: 08/937,479

[22] Filed: Sep. 25, 1997

[51] Int. Cl.[6] ..... B65D 85/00

[52] U.S. Cl. ..... 206/526; 206/338; 206/574; 206/579; 211/58; 211/78; 248/206.5

[58] Field of Search ..... 43/54.1; 206/315.1, 206/315.11, 338, 340, 348, 574, 579, 526; 211/8, 53, 56, 58, 70, 78, 164, 411.11, 49.1, 50, 59.4, 82–84; 248/206.5

[56] References Cited

U.S. PATENT DOCUMENTS

| | | | |
|---|---|---|---|
| 473,508 | 4/1892 | Jenkins | 40/499 |
| 2,017,698 | 10/1935 | Levy | 383/69 |
| 2,064,432 | 12/1936 | Keidel | 383/69 |
| 2,093,276 | 9/1937 | Kase et al. | 383/69 |
| 2,511,730 | 6/1950 | McClain | 211/50 |
| 3,260,006 | 7/1966 | Dunajew | 211/50 |
| 3,350,045 | 10/1967 | Mayers | 248/206.5 |
| 4,791,752 | 12/1988 | Van Kampen . | |
| 5,020,269 | 6/1991 | Gentry . | |
| 5,116,139 | 5/1992 | Young et al. | 383/69 |
| 5,123,197 | 6/1992 | Gentry . | |
| 5,185,952 | 2/1993 | Bruce . | |
| 5,275,363 | 1/1994 | Dennis . | |
| 5,394,638 | 3/1995 | Raymond . | |
| 5,435,648 | 7/1995 | Berkoff | 383/68 |

*Primary Examiner*—Jim Foster
*Attorney, Agent, or Firm*—Henderson & Sturm

[57] ABSTRACT

An apparatus for holding and organizing small items, comprising storage bags having a bag portion and a closure portion. The apparatus further comprising at least one base member having a surface area with slots disposed therein. The slots are wider than the bag portion, but narrower than the closure portion of the bags. The slots receive the bag portions while the closure portion holds the bag within the slot.

9 Claims, 9 Drawing Sheets

PLASTIC BAG ORGANIZER AND STORAGE APPARATUS

CROSS-REFERENCE TO RELATED APPLICATIONS

Not applicable.

STATEMENT REGARDING FEDERALLY SPONSORED RESEARCH OR DEVELOPMENT

Not applicable.

MICROFICHE APPENDIX

Not applicable.

BACKGROUND OF THE INVENTION

1. Field of the Invention

This invention relates generally to an apparatus for storing and organizing small items and more particularly to an apparatus for removably holding plastic storage bags in which small items may be stored and organized.

2. Description of Prior Art

There are various devices for holding and organizing small items such as nuts and bolts, buttons and other sewing equipment, fishing lures, etc. Heretofore, these organizers have included foldable shelved compartments such as tackle boxes, or a bank of drawers within a case. Other organizers such as that disclosed in U.S. Pat. No. 5,123,197 (hereinafter the '197 patent) utilize individual plastic bags for storing items. In the '197 patent, the individual bags are grouped and secured into sets, each set of bags may then be removable secured to a mounting surface through the use of Velcro. The storage device disclosed in the '197 patent was designed for fishing lures and the like which are lightweight. As such, the Velcro means of securing the bags to the mounting surface does not readily support heavier items such as nuts and bolts. Consequently, there is a need for an organizer that takes advantage of the features of the prior art which utilize plastic storage bags for holding small items and which enables the organizer to be readily transportable or permanently fixed to a mounting surface.

BRIEF SUMMARY OF THE INVENTION

An apparatus for holding and organizing small items, comprising storage bags having a bag portion and a closure portion. The apparatus further comprising at least one base member having a surface area with slots disposed therein. The slots have a first portion and a second portion. The first portion of the slots are narrower than the closure portion but wider than the bag portion of the storage bags whereby the closure portion of the bags will not pass through the first portion of the slot. The second portion which is wide enough to receive the closure portion of the storage bag is positioned further from the surface area of the base member than the first portion of the slot.

The base member may be cylindrical with the slots disposed radially about its surface area. A support structure and dowel may be used to hold single or multiple base members in a row such that they are rotatable about their longitudinal axis thereby enabling the contents of the bags to be displayed as they rotate past. The support structures may be mounted on a horizontal or vertical surface, or the base members may be installed within a portable carrying case. Alternatively, the slotted base members may be substantially planar and arranged in single or multiple columns. The base members in the planar arrangement may be mounted directly to a support surface, or housed within an enclosure.

Alternative embodiments of the apparatus include having a substantially planar base member shaped much like a toothed comb. In this embodiment, the slots are wider than the bag portion, but narrower than the closure portion of the bags. The slots receive the bag portions while the closure portion holds the bag within the slot. The base member is supported by a support structure and may be mounted to a horizontal or vertical surface. The base member and support structure may also be rotatable about a central axis.

Therefore it is an object of the present invention to provide a method of storing small items in plastic storage bags so they will be readily viewable.

It is a further object of the present invention to provide a method of storing small items in plastic storage bags so they may be easily organized.

It is still a further object of the present invention to provide a method of storing small items in plastic storage bags so they may be easily accessed and removed.

Other objects, advantages, and novel features of the present invention will become apparent from the following detailed description of the invention when considered in conjunction with the accompanying drawings.

DETAILED DESCRIPTION OF THE INVENTION

Figure 1:
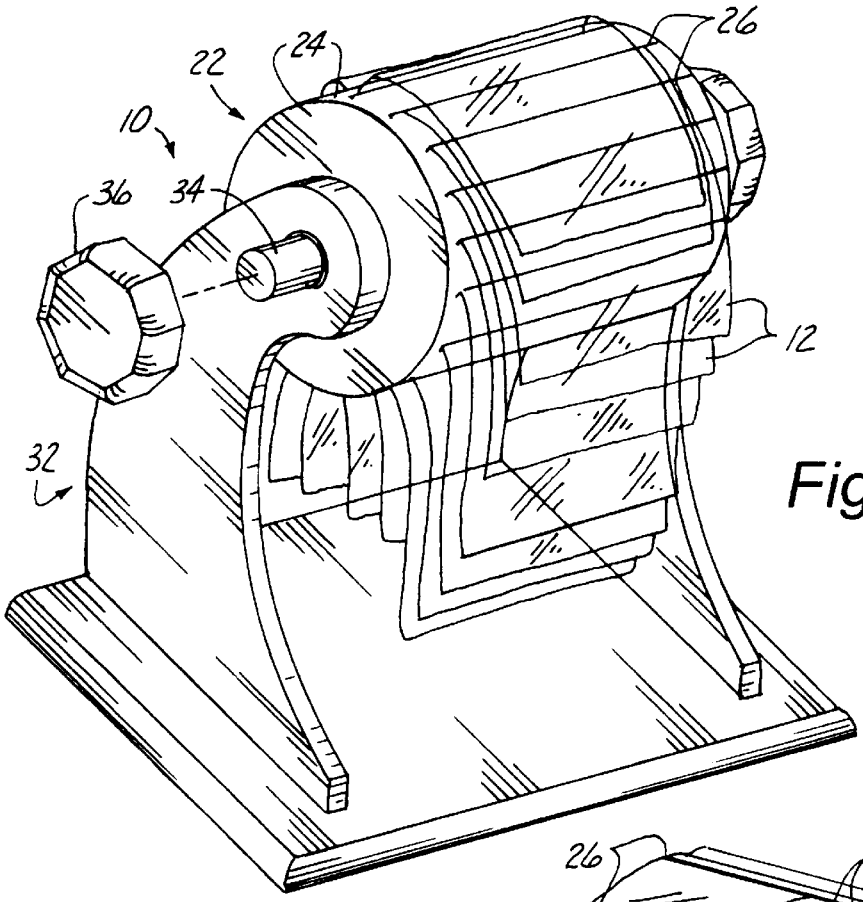
FIG. 1 is a perspective view of one embodiment of the present invention.
Figure 3:
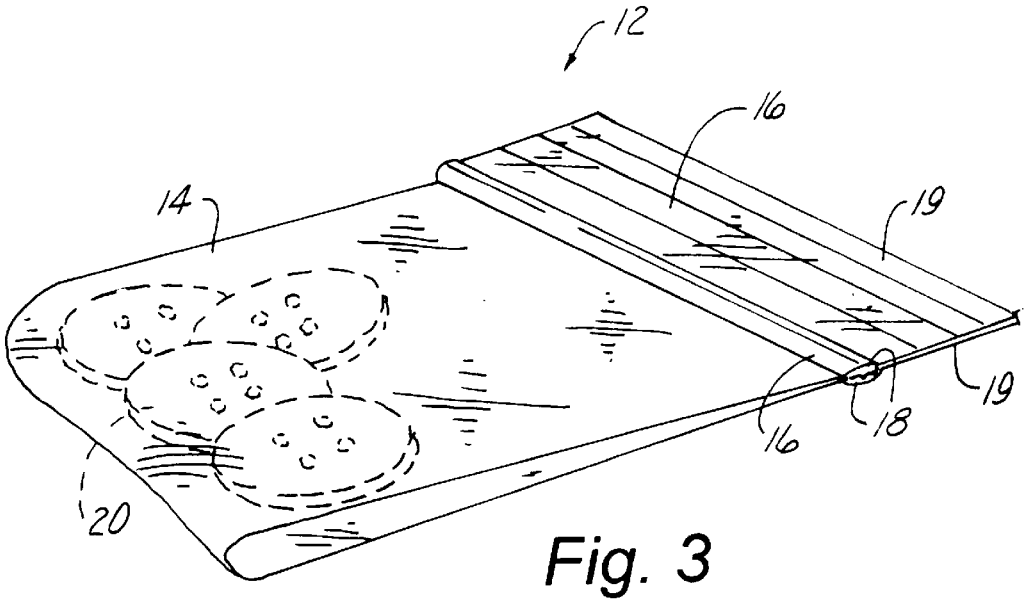
FIG. 3 is a perspective view of a typical storage bag.

Referring now to the drawings wherein like reference numerals designate identical or corresponding parts throughout the several views, FIGS. 1 shows the plastic bag organizer and storage apparatus (10) of the present invention. The storage apparatus (10) is comprised of self-sealing plastic storage bags (12) commonly referred to as zipper bags for which Ziploc® storage bags are well known. The bags (12) include a bag portion (14) (FIG. 3) and a closure portion (16). The closure portion (16) includes male and female rib members (18) on opposing end panels (19) of the bag (12). When the ribs (18) are in mating engagement, the bag (12) is substantially sealed along the axis of the rib members (18) thereby sealing in the contents (20) of the bags (12).

Figure 4:
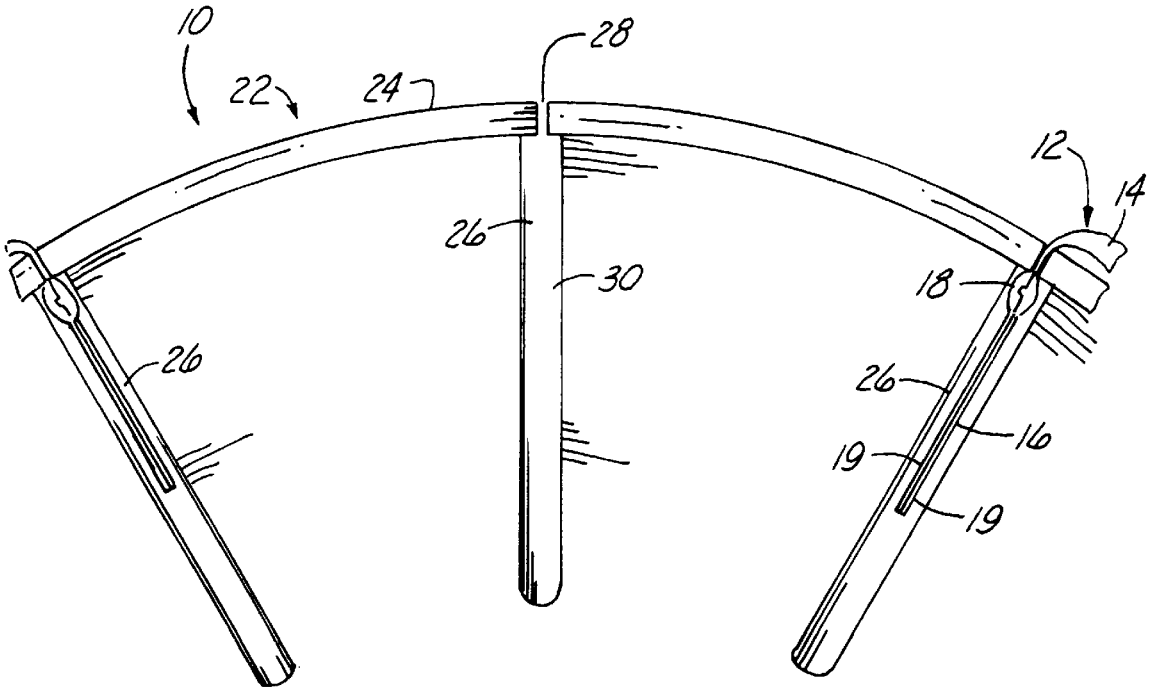
FIG. 4 is a side elevation view of a portion of the base member illustrating the slotted receptacles.

The storage apparatus (10) is further comprised of a base member (22), preferably constructed of wood, plastic or other rigid material having a surface area (24) (best viewed in FIG. 4). A plurality of slots (26) are disposed in the surface area (24). The slots (26) include a first portion (28) and a second portion (30). The first portion (28) of the slots (26) are narrower than the closure portion (16) of the storage bags (12) but wider than the thickness of the bag portion (14) of the storage bags (12). The second portion (30) of the slots (26) are wider than the closure portion (16) of the storage bags (12). The preferred dimensions for the first portion (28) of the slots (26) is 1/32 inch. The preferred dimension for the second portion (30) of the slots (26) is 1/8 inch. It should be appreciated that the narrow first portion (28) is designed to receive the bag portion (14) of the storage bag (12) and the wide second portion (30) is designed to receive the closure portion (16) of the bag (12). When the bag (12) is inserted into the slot (26) the closure portion (16) of the bag (12) will not pass through the narrow first portion (28) of the slot (26) thus removably securing the bag (12) within the slot (26).

The length of the slot (26) may vary depending on the size of the bags (12) to be inserted into the slots (26). For example, the slot (26) may need to be longer for larger bags (12) having longer end panels (19) at their closure portions (16). The lengths of the slots (26) is not critical, however, to the use of the apparatus (10). It is recommended however, that the length of the slot (26) be shorter than the length of the end panels (19) of the closure portion (16) of the bag (12). The shorter slot (26) will cause the edge of the end panels (19) to fold within the slot (26) as the bag (12) is being inserted, thereby causing the bag (12) to be held more securely within the slot (26) and making it more difficult for the bag (12) to slide out of the access openings (27) (discussed below) at the ends of the base member (12) as the apparatus (10) is moved, rotated or accidentally dropped.

Figure 2:
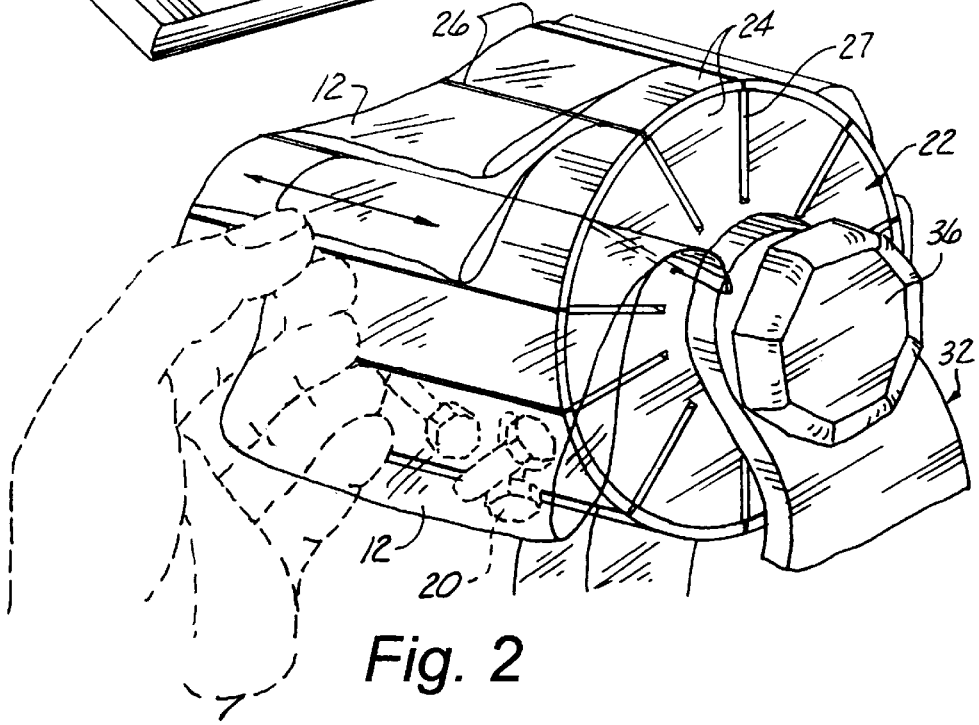
FIG. 2 is a persective view showing a storage bag being inserted into a slot in the base member.

Referring back to FIGS. 1 and 2, one embodiment of the present invention (10) utilizes a cylindrical base member (22) which is rotatable about its longitudinal axis. The plurality of equally spaced slots (26) are disposed radially about the surface area (24) of the cylindrical base member (22). In this embodiment, it should be noticed that access openings (27) are located at least one end of the cylindrical base (22) such that the bags (12) may be removably inserted through the opened end of the slots (26) as shown in FIG. 2.

The apparatus (10) also includes a support structure (32) for supporting the rotatable, cylindrical base member (22). A dowel or axle (34) extends through the central axis of the cylindrical base member (22) and is rigidly fixed thereto. The dowel or axle (34) also extends through and is supported at its ends by the support structure (32). The dowel or axle (34) is rotatable within the support structure and terminates with handles (36) rigidly secured thereto. By turning the handles (36), the base member (22) will rotate about its central axis, thereby causing the storage bags (12) to flip by much like a Rolodex® displaying their contents. The bag (12) containing the desired contents (20) can then be removed by sliding the bag (12) out of the base member (22) through the end of the slot (26).

Figure 5:
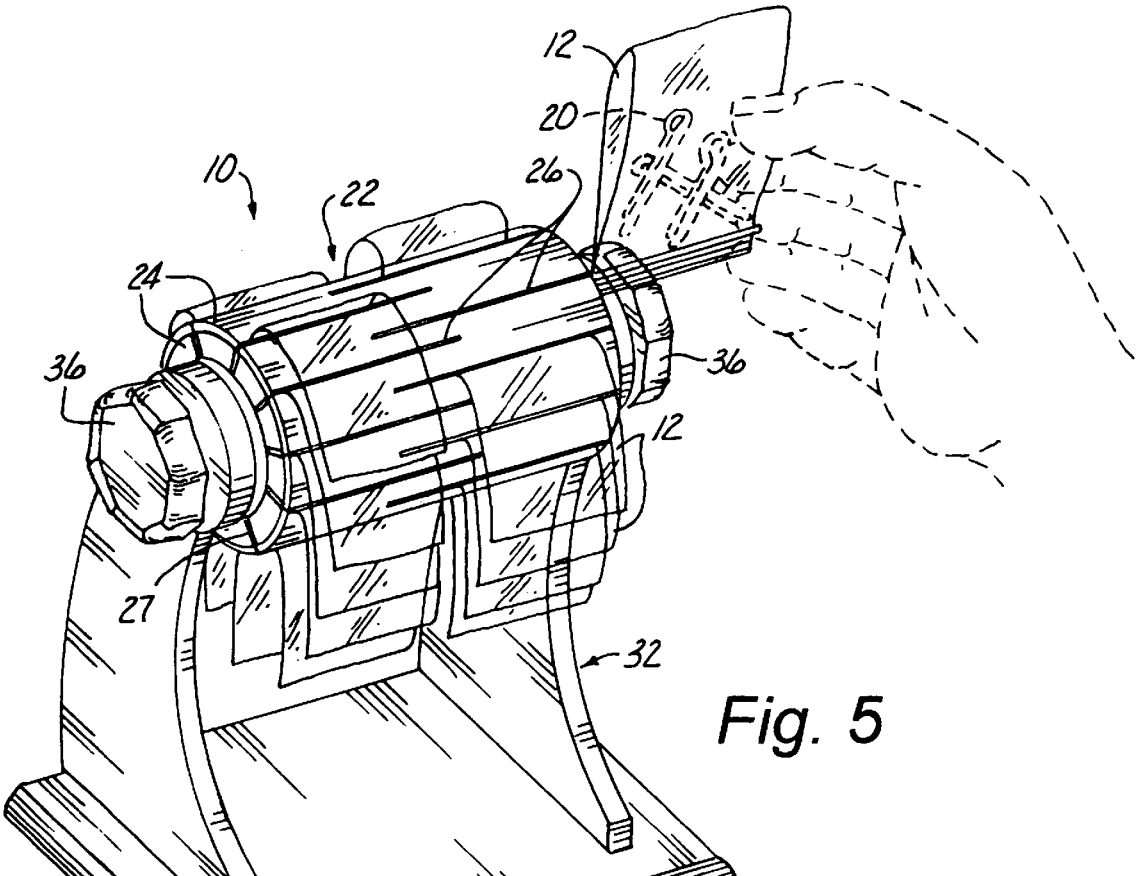
FIG. 5 is a perspective view of an alternative embodiment of the present invention showing a longer base member with offset, opposing slots.
Figure 6:
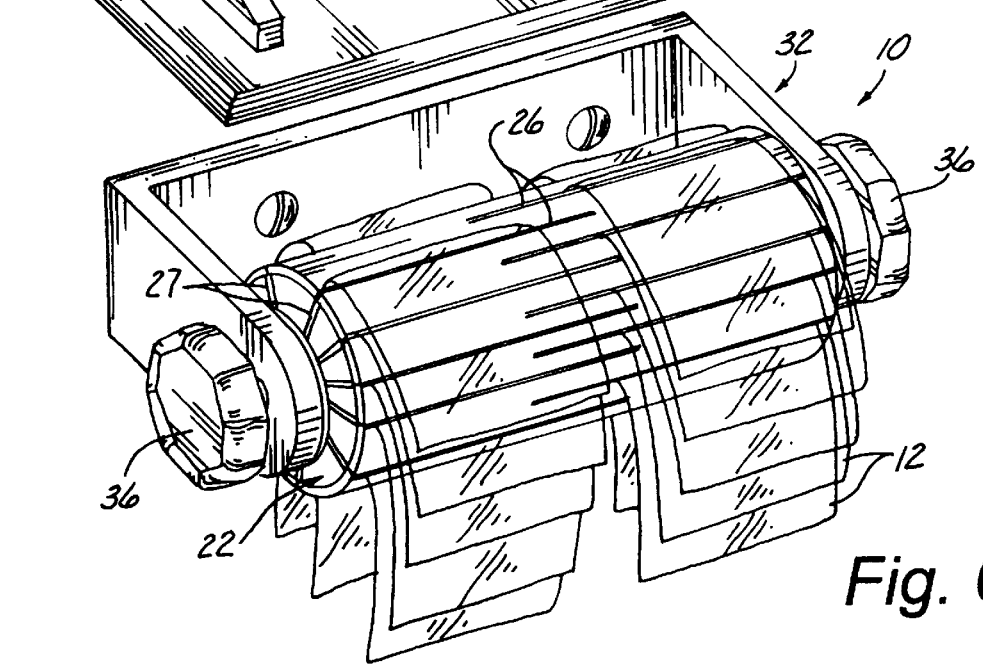
FIG. 6 is a perspective view of another alternative embodiment of the present invention showing a long base member with offset, opposing slots.

Alternate embodiments similar to that just described are shown in FIGS. 5 and 6. In these embodiments, two rows of bags (12) may be installed on the base member (22). Rather than having one long slot (26) into which two bags (12) are inserted, the slots (26) are staggered or offset. FIGS. 5 and 6 are the same embodiment other than the support structure (32). In FIG. 5, like FIG. 1, the apparatus (10) is free standing and portable. The embodiment of FIG. 6, illustrates an apparatus (10) with a support structure (32) for fastening to a wall.

Figure 7:
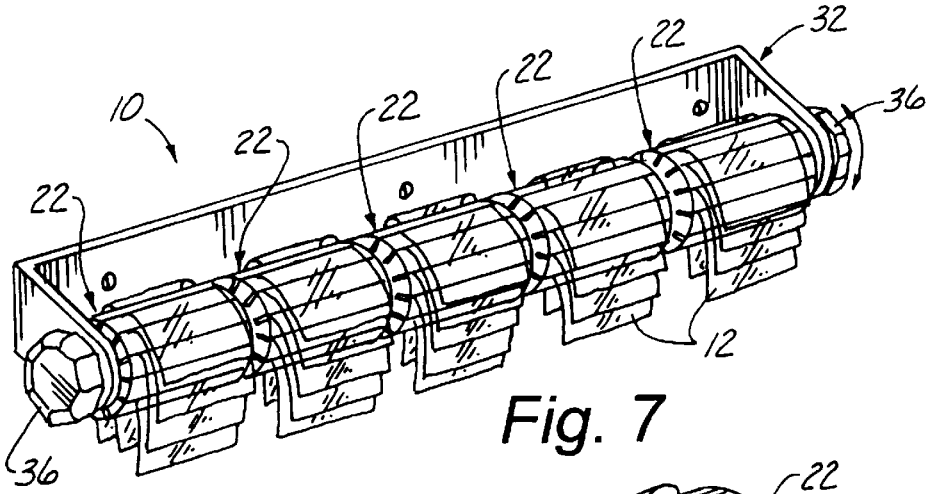
FIG. 7 is a perspective view of another alternative embodiment of the present invention showing a plural of shorter base members arranged in a row.
Figure 8:
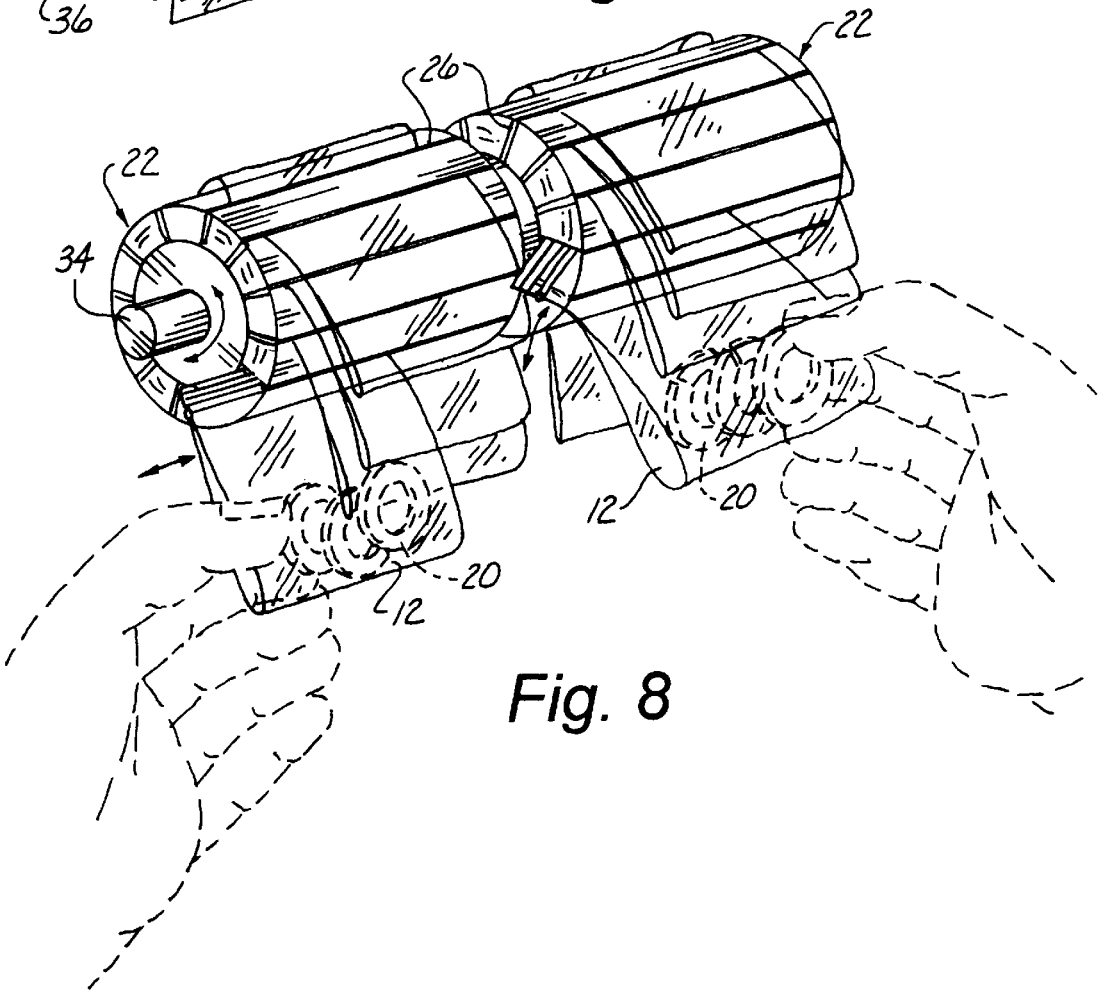
FIG. 8 is a detailed view of the base members of FIG. 7 showing the plastic storage bags being removed from adjacent base members.

FIGS. 7 and 8 show an embodiment similar to that described in FIG. 6 in which the support structure (32) of the apparatus (10) can be mounted onto a wall. FIG. 7 also illustrates that multiple base members (22) may be placed adjacent to each other along the length of the dowel or axle (34) (not visible) to provide a number of rows for storing items. The storage bags (12) may be removed through the ends of the slots (26) of each individual base member (22) as shown in FIG. 8.

Figure 9:
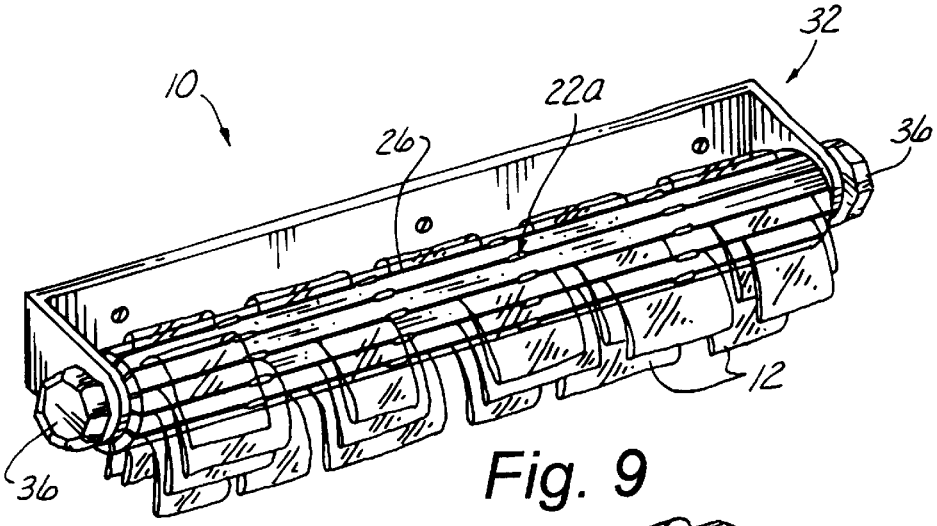
FIG. 9 is a perspective view of another alternative embodiment of the present invention showing a single long base member with long slots. Larger receptacles are spaced along the slots to enable the removal of the interior storage bags without having to remove the storage bags at the ends.
Figure 10:
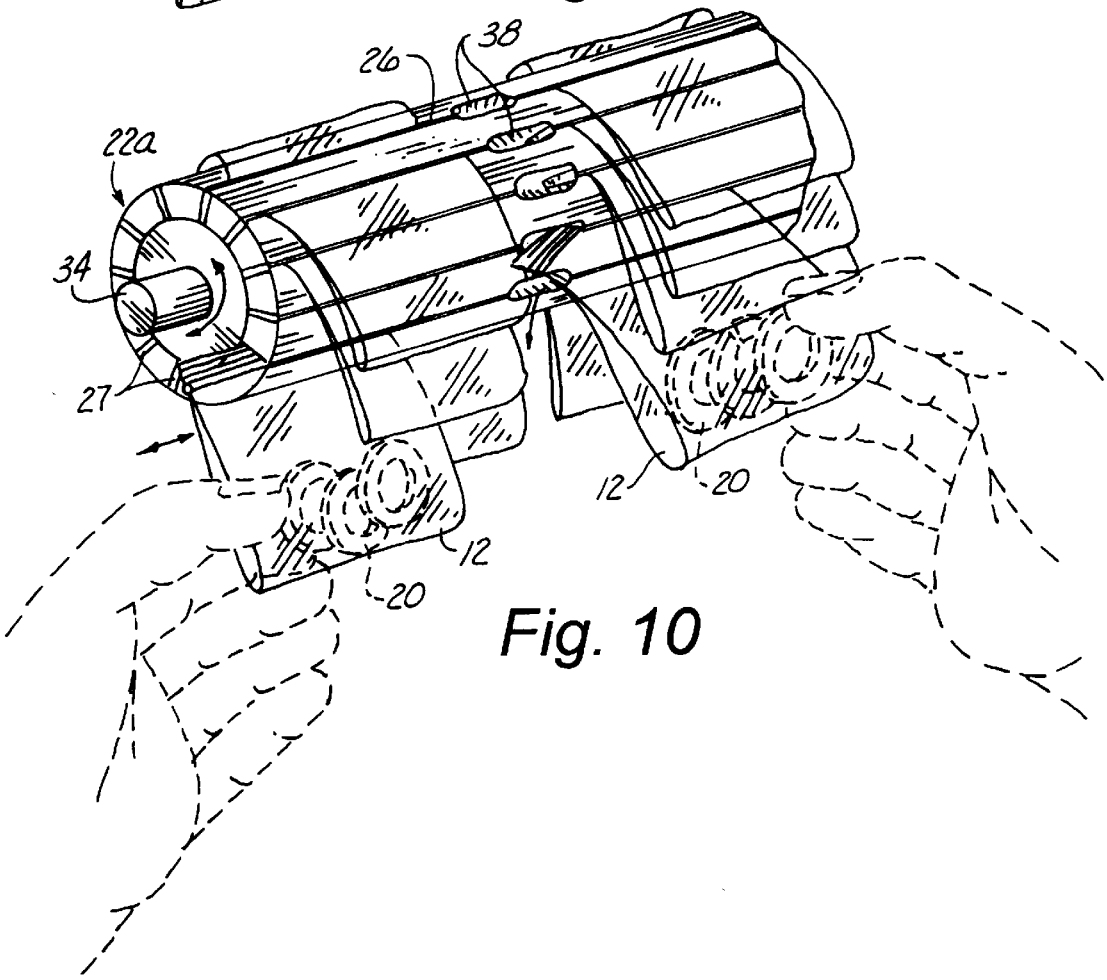
FIG. 10 is a detailed view of the base member of FIG. 10 showing the plastic storage bags being removed.

FIGS. 9 and 10 are similar to FIGS. 7 and 8 except that instead of having multiple base members (22) adjacent to each other along the dowel (34), one continuous base member (22*a*) with slots (26) running the length of the base member (22*a*) may be used. Along the length of the continuous slots (26) are enlarged slotted grooves (38). These enlarged grooves (38) are positioned to enable the storage bags (12) to be removed from the continuous slots (26) (see FIG. 10) without having to remove all of the bags (12) toward the ends of the continuous slot (26) before the interior bags (12) may be removed. Obviously the number of bags (12) that may fit in one of the continuous slots (26) is determined by bag size, and it should be understood that large bags (12) may extend over one or more of the enlarged slotted grooves (38).

Figure 11:
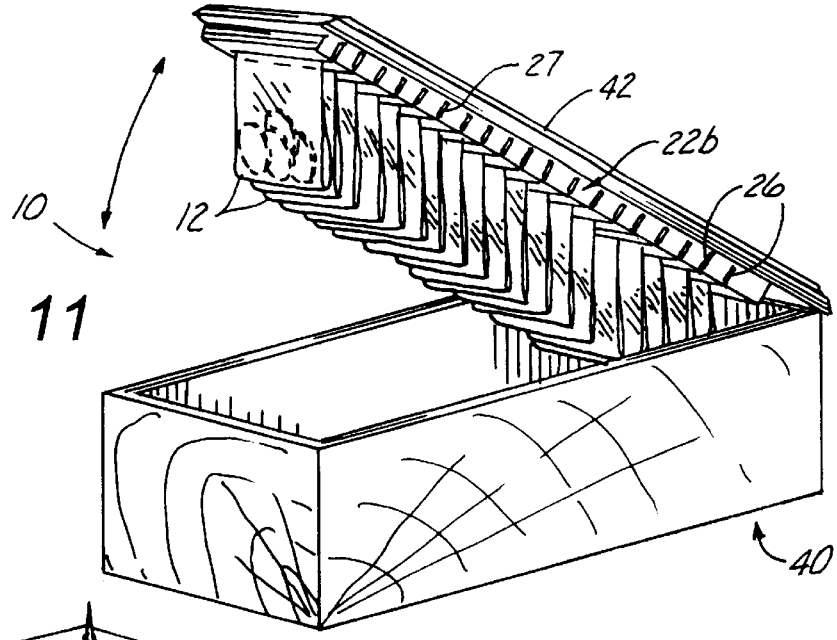
FIG. 11 is a perspective view of another alternative embodiment of the present invention showing the base member disposed within an enclosure.
Figure 12:
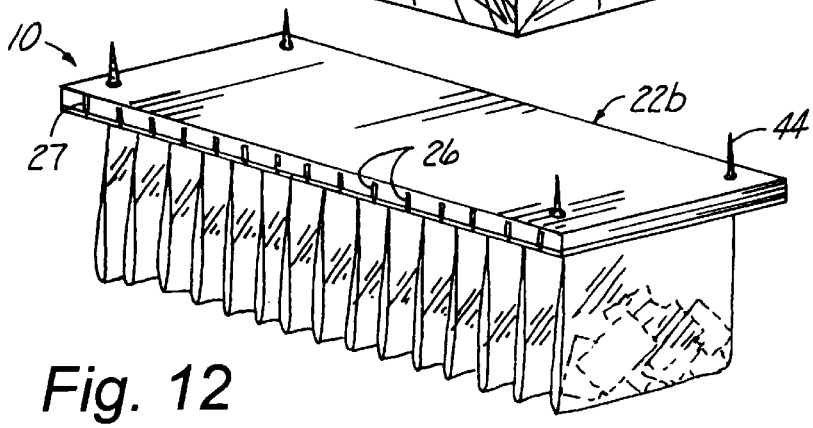
FIGS. 12–14 are perspective views of alternative embodiments of the present invention showing that the base may be mounted directly to a horizontal or vertical surface.
Figure 13:
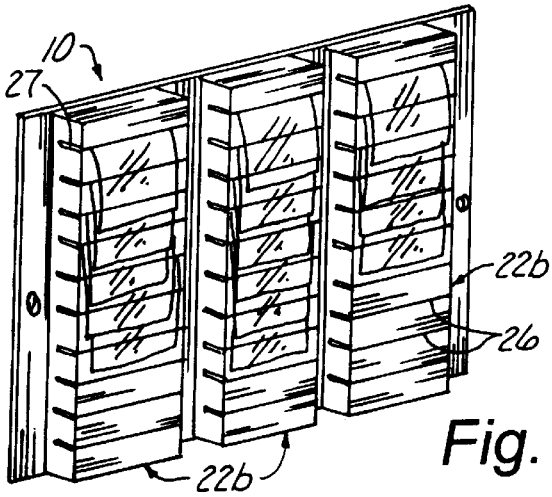
Figure 14:
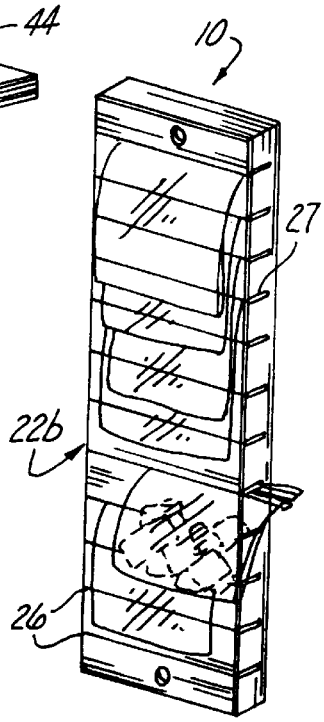

Rather than having a Rolodex® type of apparatus (10) as shown in FIGS. 1–10, the storage bag apparatus (10) may be of the types shown in FIGS. 11–14. FIG. 11, shows an embodiment of the apparatus (10) used in conjunction within an enclosure (40), with the base member (22*b*) having slots (26) attached to a hinged lid (42). FIG. 12 shows an embodiment in which the apparatus (10) may be attached to a horizontal surface with screws (44), such as an existing shelf or low ceiling. FIGS. 13 and 14 illustrate the apparatus (10) in a vertical arrangement of single row base members (22) (FIG. 14) or multiple row base member (22*b*) arrangements (FIG. 13) for mounting on a wall or other vertical surface.

Figure 15:
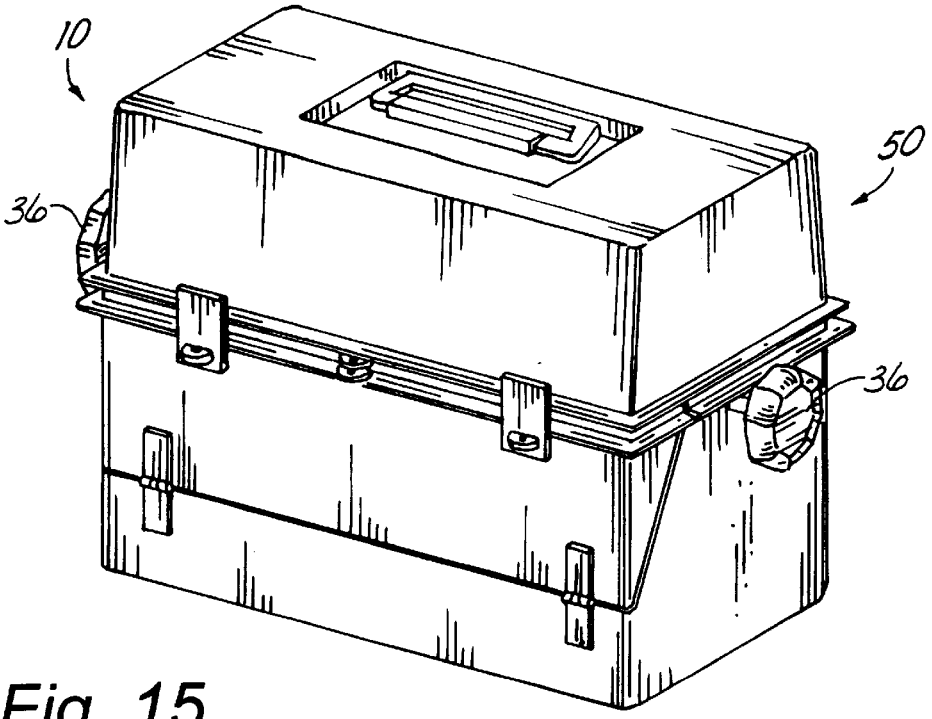
FIGS. 15 and 16 are still further alternative embodiments showing the present invention within a portable carrying.
Figure 16:
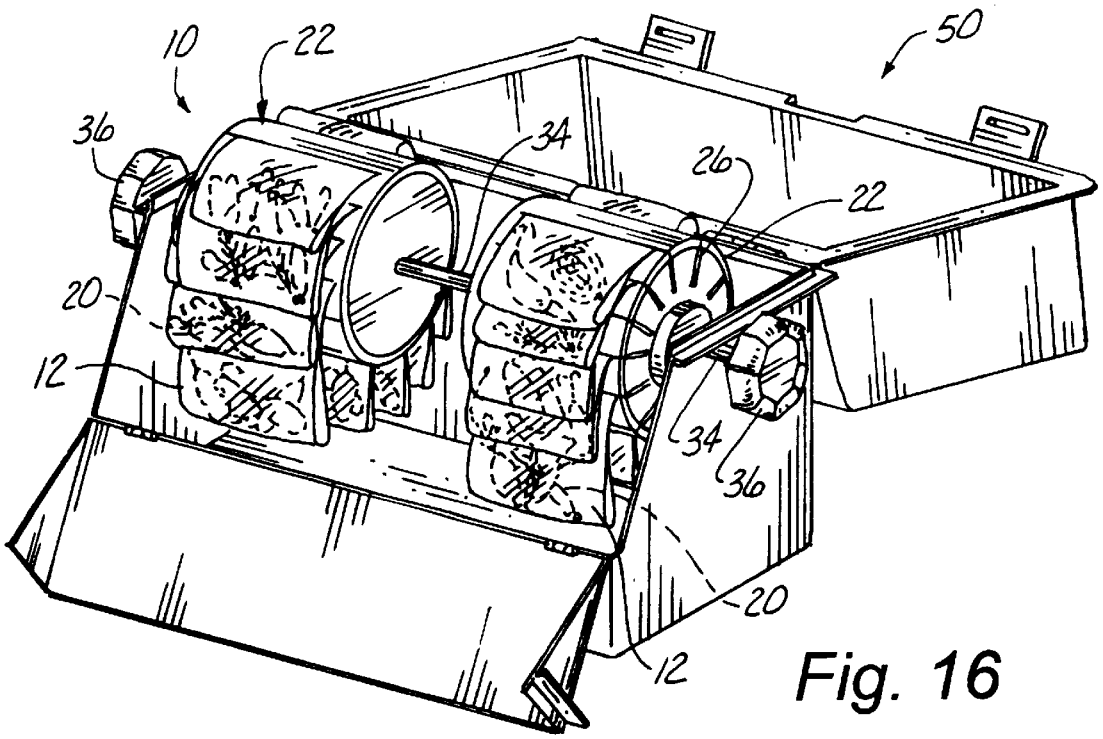

FIGS. 15 and 16 show the apparatus (10) mounted inside a common carrying case (50) constructed of plastic, metal or other durable material. This application is particularly useful for carrying fishing tackle and the like as fishing tackle is commonly sold in small zipper bags. The base members (22) having slots (26) are disposed within the case (50), and are mounted to a dowel or axle (34) as in the previously described embodiments. The dowel (34) extends through the sides of the carrying case (50) and terminates with handles (36) fixed at each end. The handles (36) are disposed on the outside of the carrying case (50) for easier access and may be turned causing the storage bags (12) filled with varying contents (20) to flip around much like a Rolodex® as previously described. When the bag (12) containing the desired contents (20) is located, the bag (12) can be removed from its slot (26).

Figure 17:
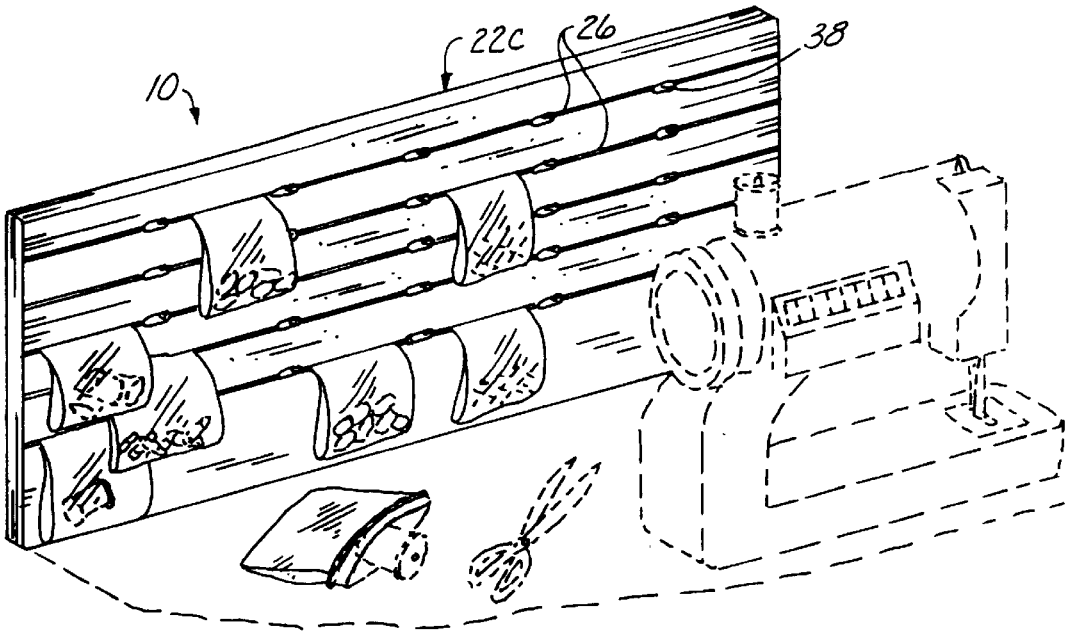
FIGS. 17–20 are perspective views of still further alternative embodiments of the present invention.

FIG. 17 illustrates yet another embodiment of the apparatus (10) of the present invention. This embodiment is similar to the embodiment of FIG. 13, except that the base member (22*c*) includes continuous slots (26) running the length of the base member (22*c*). The slots (26) further include enlarged slotted grooves (38) similar to those shown in FIGS. 9 and 10. The enlarged grooves (38) enable the storage bags (12) located near the middle of the continuous slots (26) to be removed without having to slide the bags (12) all the way to the ends of the continuous slots (26). It should be appreciated that such an arrangement eliminates the need for having access openings in the sides of the base member (22*c*). This will give the base member (22*c*) more of a finished look.

Figure 18:
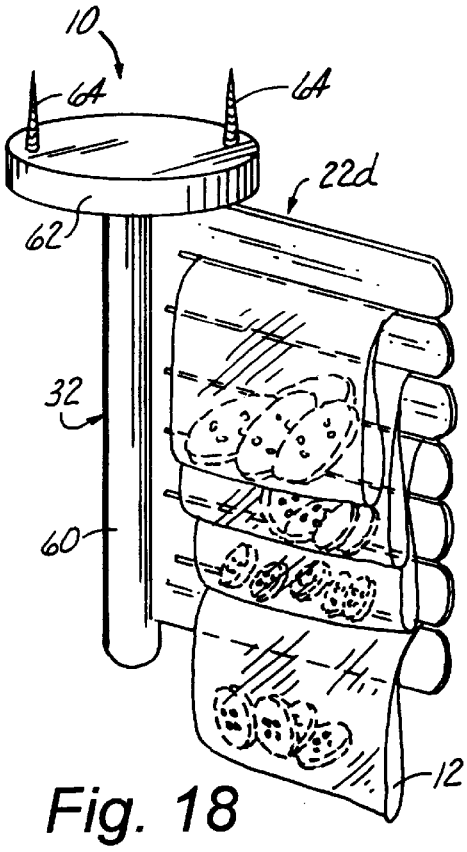
Figure 19:
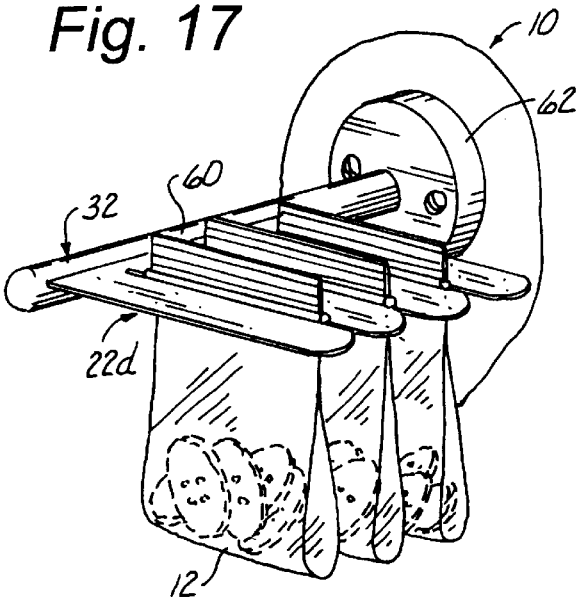
Figure 20:
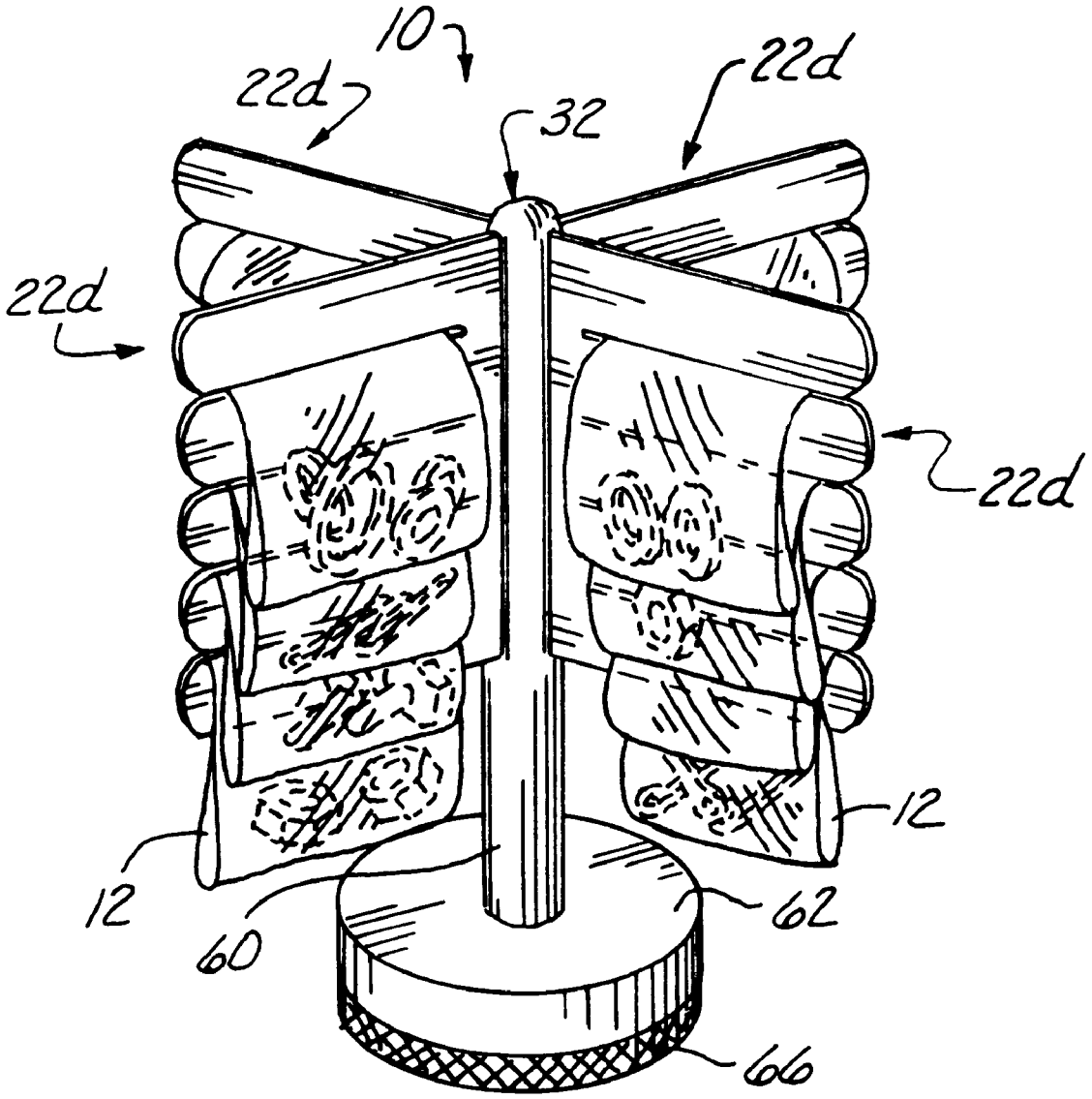

The embodiments shown in FIGS. 18–20 are unlike the previously described embodiments. The base member (22*d*) is constructed like a comb. The slots (26*a*) do not have a narrow first portion and a wide second portion as in the previous embodiments. Rather, the base member (22*d*) is constructed out of substantially thin planar material. The slots (26*a*) are then simply cut into the planar base member (22*d*) resulting in the base member resembling a comb. The slots (26*a*) are narrower than the closure portion (16) but wider than the bag portion (14) of said storage bags (12), whereby the slots (26*a*) will receive the bag portion (14) of the storage bags (12), but the closure portion (16) of the bag (12) will not be able to pass through the slot (26*a*). The support structure (32) for the comb-shaped base member (22*d*) is simply a dowel or bar (60) fixed to a support base (62). The method of attaching the base member (22*d*) to the dowel or bar (60) will vary depending on the material from which the apparatus (10) is constructed. If the apparatus (10) is constructed of metal, the base member (22*d*) may be welded, soldered, bolted, etc. to the dowel or bar (60). If the apparatus (22*d*) is constructed of wood or plastic, the base member (22*d*) may be attached to the dowel or bar (60) by any number of methods including glue, a tongue and groove connection, nailing, or a combination of these methods and others. The support base (62) may be securely mounted to a horizontal or vertical surface by a threaded fastener (64) (FIGS. 18 and 19) or alternatively, the support base (62) may be removably attached to a surface, for example, by incorporating a magnet (66) (FIG. 20) onto its lower surface. Additionally, the support base (62) or dowel (60) may be rotatably mounted to a supporting surface thereby enabling the base member (22*d*) to be rotated about a vertical axis.

Obviously many modifications and variations of the present invention are possible in light of the above teachings. It is therefore to be understood that, within the scope of the appended claims, the invention may be practiced otherwise than as specifically described.

I claim:

1. An apparatus for storing and organizing small items, comprising:

at least one storage bag of a type including a bag portion and a closure portion, said closure portion being thicker than said bag portion when said bag portion is empty;

a base member having a substantially cylindrical surface area and being rotatable about an axis;

a plurality of slots disposed in said surface area, wherein each slot includes a first portion which is narrower than the closure portion but wider than the bag portion of said storage bag whereby the closure portion of said storage bag will not pass through the first portion of said slot, and a second portion which is wide enough to receive the closure portion of said storage bag and being positioned further from the surface area of said base than the first portion of said slot.

2. The apparatus of claim 1 including an access opening through said surface area of said base whereby the closure portion of the bag can be placed in said second portion of said slot with the bag portion being disposed through said first portion of said slot.

3. The apparatus of claim 1 wherein said apparatus includes a support structure for supporting said base member.

4. The apparatus of claim 3 wherein said support structure comprises a carrying case.

5. The apparatus of claim 3 wherein said support structure comprises an enclosure.

6. An apparatus for storing and organizing small items in storage bags of a type including a bag portion and a closure portion, said closure portion being thicker than said bag portion when said bag portion is empty; comprising:

a base member having a surface area;

a plurality of staggered slots disposed in said surface area adapted to removably receive a storage bag, each of said slots having a first portion, a second portion, and an access opening, said access openings for said staggered slots being disposed on opposite side edges of said base member, said first portion being narrower than the closure portion but wider than the bag portion of the storage bag, said second portion being wide enough to receive the closure portion of the storage bag and being positioned further from the surface area of said base than the first portion of said slot, whereby the closure portion of the bag can be placed in said second portion of said slot with the bag portion being disposed through said first portion of said slot.

7. An apparatus for storing and organizing small items in storage bags of a type including a bag portion and a closure portion, said closure portion being thicker than said bag portion when said bag portion is empty; comprising:

a base member having a substantially cylindrical surface area and being rotatable about an axis;

a plurality of slots disposed in said surface area adapted to removably receive a storage bag, each of said slots having a first portion, a second portion, and an access opening, said access opening including at least one enlarged groove portion disposed along the length of each slot, said first portion being narrower than the closure portion but wider than the bag portion of the storage bag, said second portion being wide enough to receive the closure portion of the storage bag and being positioned further from the surface area of said base than the first portion of said slot, whereby the closure portion of the bag can be placed in said second portion of said slot with the bag portion being disposed through said first portion of said slot.

8. An apparatus for storing and organizing small items; comprising:

at least one storage bag of a type including a bag portion and a closure portion, said closure portion being thicker than said bag portion when said bag portion is empty;

a substantially planar base member having a surface area;

a plurality of slots disposed in said surface area, wherein said slots are arranged in at least one column and wherein said column includes at least one row of said slots, and further wherein each of said slots includes a first portion, a second portion, and an access opening, said first portion being narrower than the closure portion but wider than the bag portion of the storage bag, said second portion being wide enough to receive the closure portion of the storage bag and being positioned further from the surface area of said base than the first portion of said slot, whereby the closure portion of the bag can be placed in said second portion of said slot with the bag portion being disposed through said first portion of said slot.

9. The apparatus of claim 8 wherein said access openings are on opposite ends of said substantially planar base member.

* * * * *